US006783019B2

(12) United States Patent
Zettle et al.

(10) Patent No.: US 6,783,019 B2
(45) Date of Patent: Aug. 31, 2004

(54) CONTAINER LID WITH SELECTABLE OPENING

(76) Inventors: Jeffrey J. Zettle, 1573 Midland Rd., Bay City, MI (US) 48706; Gregory Ball, 9251 Eureka Rd., Girard, PA (US) 16417; Anthony Weber, 3603 Canada Goose Crossing, Racine, WI (US) 53405; Anthony R. Miller, 251 The Blvd., Pittsburgh, PA (US) 15210; William L. DiMieri, 5066 Impala Dr., Murrysville, PA (US) 15668

( * ) Notice: Subject to any disclaimer, the term of this patent is extended or adjusted under 35 U.S.C. 154(b) by 22 days.

(21) Appl. No.: 09/951,455

(22) Filed: Sep. 14, 2001

(65) Prior Publication Data

US 2003/0052126 A1 Mar. 20, 2003

(51) Int. Cl.[7] ..... A47G 19/22

(52) U.S. Cl. ..... 220/254.3; 220/705; 220/709

(58) Field of Search ..... 220/525, 254.3, 220/713, 714, 703, 705, 709; 222/482, 556, 485, 486, 129, 142.6

(56) References Cited

U.S. PATENT DOCUMENTS

| | | | | | |
|---|---|---|---|---|---|
| 843,356 | A | * | 2/1907 | Parker | 222/142.6 |
| 890,304 | A | * | 6/1908 | Rosenberg | 222/142.6 |
| 1,184,549 | A | * | 5/1916 | McClung | 220/254.3 |
| 2,754,866 | A | * | 7/1956 | Coltman, Jr. | 220/254.3 |
| 2,833,447 | A | * | 5/1958 | Thiele | 222/556 |
| 3,281,024 | A | | 10/1966 | Henchert et al. | 222/484 |
| 3,994,411 | A | | 11/1976 | Elfert et al. | 220/90.4 |
| D247,211 | S | * | 2/1978 | Young | D7/392 |
| D253,338 | S | | 11/1979 | Hasegawa | D9/253 |
| 4,202,459 | A | | 5/1980 | DeParales et al. | 220/90.4 |
| 4,232,797 | A | | 11/1980 | Waterbury | 220/359 |
| D263,933 | S | | 4/1982 | Jones et al. | D9/447 |
| D272,323 | S | | 1/1984 | Bainton | D9/438 |
| D278,312 | S | | 4/1985 | Cleevely et al. | D9/449 |
| 4,545,508 | A | | 10/1985 | Cribb, Jr. et al. | 222/153 |
| D285,661 | S | | 9/1986 | Brownbill | D9/435 |
| 4,629,088 | A | | 12/1986 | Durgin | 220/254 |
| 4,723,693 | A | | 2/1988 | DeCoster | 222/483 |
| 4,735,334 | A | | 4/1988 | Abbott | 220/259 |
| 4,738,373 | A | | 4/1988 | DeParales | 220/254 |
| 4,779,766 | A | | 10/1988 | Kinsley | 222/153 |
| 4,782,985 | A | | 11/1988 | Kinsley | 222/481.5 |
| 4,881,668 | A | | 11/1989 | Kitterman et al. | 222/482 |
| 4,887,747 | A | * | 12/1989 | Ostrowsky et al. | 222/556 |
| 4,949,865 | A | | 8/1990 | Turner | 220/90.4 |
| D312,552 | S | | 12/1990 | Carlson | D7/321 |
| 4,989,746 | A | | 2/1991 | Pierce | 220/254 |

(List continued on next page.)

FOREIGN PATENT DOCUMENTS

WO WO 03/042058 A2 5/2003

OTHER PUBLICATIONS

Phoenix Closures Coffee–mate® Package Lid, Late Summer/Early Fall 2001.

*Primary Examiner*—Nathan J. Newhouse

(57) ABSTRACT

A lid includes a top having a cover receiving portion having a first aperture and a second aperture formed therein, a hinge positioned about a center of the cover receiving portion such that the first aperture is on one side of the hinge and the second aperture is on an opposite side of the hinge, and a cover having two directly opposing sidewalls rotatably attached to the cover receiving portion via the hinge. Each sidewall includes a protrusion extending therefrom shaped to fit within one of the first and second apertures. The cover pivots relative to the cover receiving portion so as to engage either the first aperture or the second aperture, and when the protrusion on one sidewall of the cover is pivoted towards the first aperture, the protrusion on the other sidewall simultaneously pivots away from the second aperture.

18 Claims, 6 Drawing Sheets

U.S. PATENT DOCUMENTS

| | | | | | |
|---|---|---|---|---|---|
| D315,872 | S | | 4/1991 | Bixler | D9/446 |
| D321,624 | S | | 11/1991 | Fiore et al. | D7/321 |
| 5,110,002 | A | | 5/1992 | Tucker | 220/254 |
| 5,111,961 | A | | 5/1992 | Van Melle | 220/712 |
| 5,148,936 | A | | 9/1992 | DeGrow | 220/254 |
| 5,219,100 | A | | 6/1993 | Beck et al. | 222/480 |
| 5,244,113 | A | * | 9/1993 | Stymiest | 222/482 |
| D356,499 | S | | 3/1995 | Cautereels et al. | D9/449 |
| 5,397,023 | A | | 3/1995 | Toczek et al. | 220/709 |
| 5,415,312 | A | * | 5/1995 | Mueller | 220/254.3 |
| 5,425,471 | A | | 6/1995 | Wendt | 220/705 |
| D363,671 | S | | 10/1995 | Mueller | D9/447 |
| 5,503,289 | A | | 4/1996 | Fox | 220/254 |
| D372,866 | S | | 8/1996 | Ahern, Jr. | D9/449 |
| D379,738 | S | | 6/1997 | Liming et al. | D7/511 |
| D382,203 | S | | 8/1997 | Fonville | D9/449 |
| D387,619 | S | | 12/1997 | Gross et al. | D7/510 |
| 5,794,819 | A | * | 8/1998 | Smith | 222/129 |
| D410,174 | S | | 5/1999 | Sheu | D7/510 |
| 5,947,323 | A | | 9/1999 | Freek et al. | 220/709 |
| 5,960,987 | A | | 10/1999 | Solland et al. | 220/834 |
| 6,131,763 | A | | 10/2000 | Stanish et al. | 220/706 |
| 6,230,924 | B1 | | 5/2001 | Weiss et al. | 220/713 |
| 6,315,145 | B1 | | 11/2001 | Fask et al. | |

* cited by examiner

CONTAINER LID WITH SELECTABLE OPENING

BACKGROUND OF THE INVENTION

1. Field of the Invention

This invention relates generally to a lid for a container, and more particularly, to a removable lid having two apertures therein and a cover adapted to contact either of the apertures by pivoting on the lid.

2. Description of the Related Art

During outdoor activities, objects in the environment such as flies, mosquitoes, hornets, dust, rain, and the like seem to find their way into open beverage containers. People prefer to avoid contact with such extraneous matter, and especially do not desire to have it in and about the containers from which they drink. Children, and even many adults, sometimes refuse to consume the contents of a container after witnessing various insects moving thereabout. More importantly, consuming a beverage into which minute particles from the air have fallen may prove unhealthy. In addition, whether indoors or outdoors, many people desire a drinking container that does not readily spill its contents when accidentally tipped or dropped.

Similarly, beverages are often consumed while in a vehicle in motion. Drivers and passengers alike generally desire beverage containers that, when tipped, shaken, or dropped, do not simply spill their contents about the vehicle cabin and its occupants. Further, whether indoors, outdoors, or in a vehicle, not everyone prefers to drink from a container in the same manner. That is, some people prefer to use a straw, while others prefer to simply drink directly from a spout. Moreover, most consumers consider beverage containers to be fungible commodities. As such, a market exists for a simple, low cost, easily manufacturable product that renders a beverage container spill proof, prevents objects from the environment from contacting its contents, and at the same time provides a consumer with the option of consuming its contents either through a straw or directly from a spout.

Conventional container lids directed towards that market generally include an opening for a straw and an opening for pouring or sipping the contents of a container. Such lids may have pairs of covers to close off the openings, as disclosed by U.S. Pat. No. 5,244,113 to Stymiest, or single removable covers to close off both openings, as disclosed by U.S. Pat. No. 5,415,312 to Mueller. However, the container lid disclosed by Stymiest requires separate first and second closures for closing off the two openings, and both the first and second closures are separately connected to the lid. This increases manufacturing complexity and requires additional assembly steps and material, which raises the cost per lid. The container lid disclosed by Mueller includes a cover that does not attach to the lid. As such, that cover is easily separated and lost.

Therefore, there is a continuing need in the art for a simple, low-cost, easily manufacturable container lid having a plurality of apertures therein that can be alternately covered by a single cover, which is hingedly attached to the lid even when none of the plurality of apertures is covered.

SUMMARY OF THE INVENTION

This invention addresses the foregoing needs in the art by providing a container lid having two apertures therein, and comprising a cover hingedly attached to the lid and adapted to cover one of the two apertures at a time by pivoting on the lid.

In a first embodiment of the invention, a container lid comprises a top including a cover receiving portion having a first aperture and a second aperture formed therein, a hinge positioned substantially about a center of the cover receiving portion, and a cover pivotally attached to the cover receiving portion via the hinge. The first aperture is positioned on one side of the hinge and the second aperture is positioned on an opposite side of the hinge. The cover comprises at least two opposing sides, with each of the opposing sides having a protrusion shaped to sealingly engage or fit within one of the first aperture and the second aperture.

In another aspect of the first embodiment, one of the apertures is adapted to receive a straw.

In yet another aspect of the first embodiment, the hinge comprises at least one protruding fork integral with the cover receiving portion, the cover comprises at least one aperture therein, and the at least one protruding fork is adapted to releasably engage the aperture in the cover.

In yet another aspect of the first embodiment, the container lid comprises a peripheral wall depending from the top. The peripheral wall comprises a ridge adapted to removably secure the lid to a container.

In a second embodiment of the invention, a container assembly comprises a container having a flanged upper lip and a lid. The lid comprises a top including a substantially flat portion having a first aperture and a second aperture formed therein, a hinge positioned substantially about a center of the flat portion, a cover pivotally attached to the flat portion via the hinge, and a peripheral wall depending from the top of the lid. The first and second apertures are positioned on opposite sides of the hinge, and the peripheral wall is adapted to releasably engage the flanged upper lip. The cover comprises at least a first side and a second side opposite the first side. Each of the first and second sides comprises a protrusion shaped to sealingly engage one of the first aperture and the second aperture.

In another aspect of the first and second embodiments, the first aperture in the flat portion comprises a seal disposed therein, so that when the cover is sealingly engaged with the second aperture, the container assembly is spill-proof and prevents environmental objects from contacting contents of the container.

In a third embodiment of the invention, a container lid comprises a top including a substantially flat portion having a first aperture and a second aperture formed therein, a cover removably attached to the flat portion, and means for removably and pivotally attaching the cover to the flat portion. The first and second apertures are positioned on opposite sides of the means for removably and pivotally attaching the cover to the flat portion. The cover comprises two sides, with each side comprising a protrusion shaped to sealingly engage (or alternatively to fit within) the first or second aperture.

BRIEF DESCRIPTION OF THE DRAWINGS

FIG. 5 is a sectional view along the line I—I in FIG. 4 while

DETAILED DESCRIPTION OF THE PREFERRED EMBODIMENTS

This invention relates generally to a container lid, comprising a top including a hinge and a plurality of apertures disposed therein and positioned on opposite sides of the hinge, and a cover pivotally connected to the lid via the hinge. The cover comprises two sides and a protrusion on each side, each protrusion being adapted to sealingly engage (or alternatively to fit within) one of the plurality of apertures in the lid.

Figure 1:
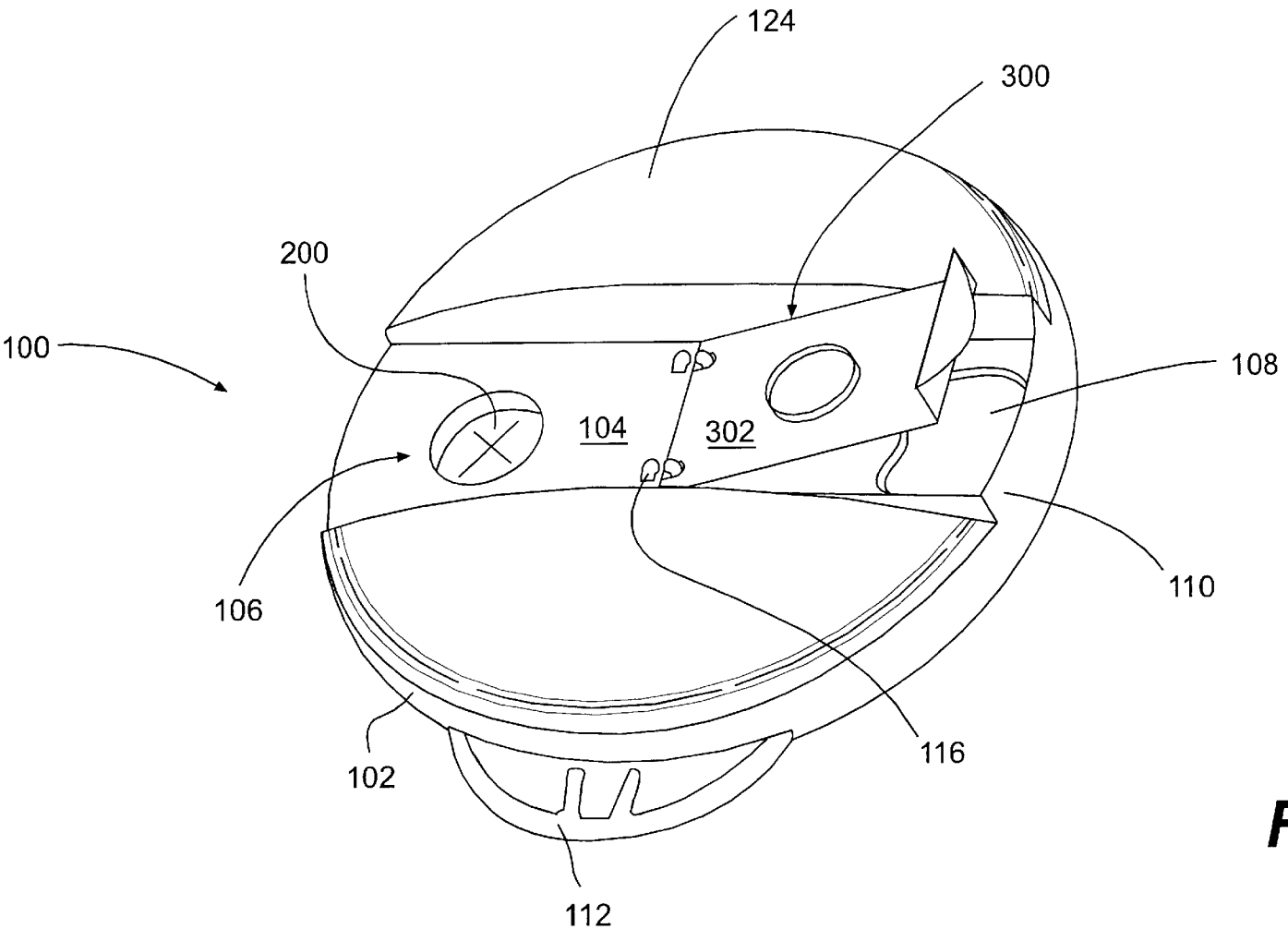
FIG. 1 is a perspective view of a top of a lid in accordance with this invention.

FIG. 1 shows a perspective view of a lid 100 according to the preferred embodiment. The lid 100 comprises a top 124 and a peripheral wall 102 depending therefrom. A circumference of the top 124 is generally circular, and a cross section of the top 124 is generally arcuate, rising from a low point at a periphery of the top 124 to a high point near a center of the top 124. A cover receiving portion, preferably a flat portion 104, extends across the top 124 and through the center of the top 124. The flat portion 104 comprises two apertures formed therein. These apertures can be the same or different. Preferably, however, one aperture is, for example, a straw hole 106 suitable for receiving a conventional straw, and another aperture is, for example, a spout 108 suitable for pouring or sipping contents of the container. Various shapes for the apertures, such as circular, elliptical, polygonal, rectangular, and the like, can be formed in the flat portion 104 without departing from the scope of the invention. Near the spout 108, the lid 100 further comprises an extending lip 110 to aid in sipping.

A tongue 112 is provided on one side of the lid 100 and is integrally formed with the wall 102 to facilitate removal and handling of the lid 100. Of course, the tongue 112 may be a separate piece, or may be disposed of altogether without departing from the scope of the invention. Moreover, the tongue 112 can be a variety of shapes and sizes, such as an arcuate, rectangular, or triangular extension from the lid.

Preferably, the straw hole 106 is provided with a gasket 200 fixedly disposed therein. Such gaskets are produced by Liquid Molding Systems, Inc., Midland, Mich., and marketed through Sequist Closures of Mukwanago, Wis., under the SIMPLISQUEEZE™ line. The gasket 200 allows for insertion of a conventional straw therethrough. When a straw or similar tube is not inserted through the gasket 200, then the gasket 200 provides a spill-proof seal, meaning that fluid contents of the container coming in ephemeral contact with the gasket 200 will not pass through the gasket 200. Although a separate gasket 200 is shown in FIG. 1, for example, the gasket 200 may be integrally formed with the lid 100. In addition, other sealers or means for receiving an object therethrough and for providing an ephemeral seal when the object is not disposed therethrough may be used without departing from the scope of the invention.

Figure 2A:
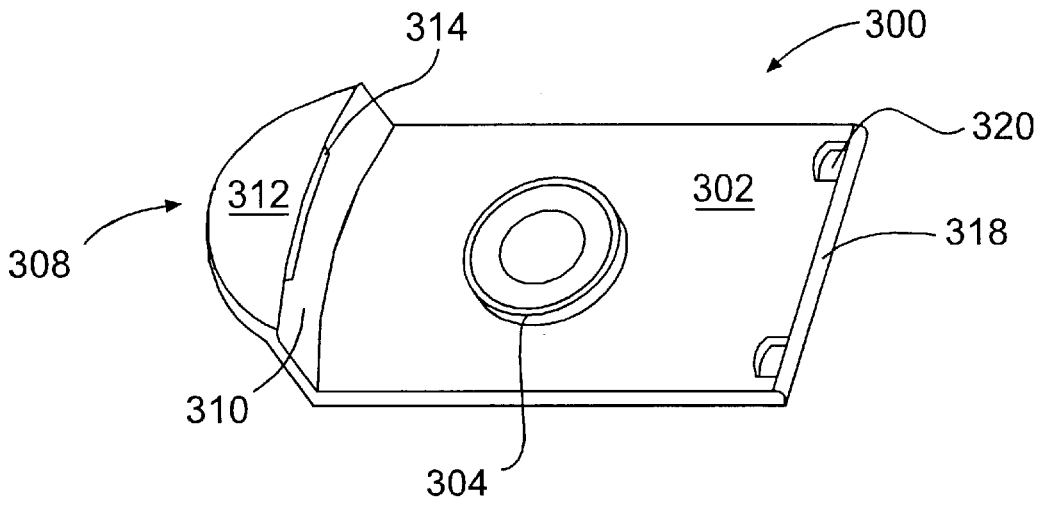
FIGS. 2A and 2B are perspective views of a cover for use in this invention.
Figure 2B:
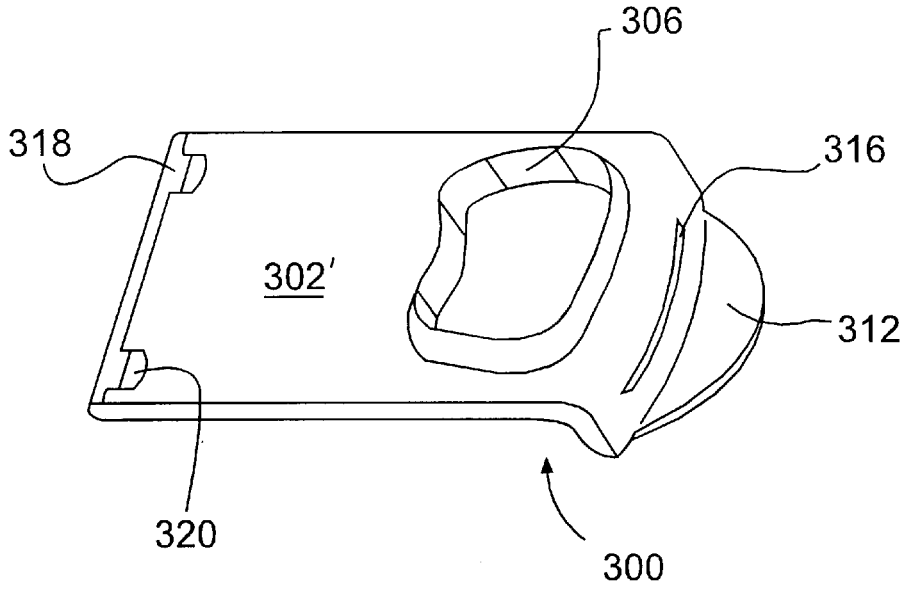

FIGS. 2A and 2B show a cover 300 for use in this invention. The cover 300 comprises two sides 302, 302' each with a protrusion 304, 306, respectively disposed thereon and shaped to sealingly engage, fit within, or mate with one of the apertures in the flat portion 104. As shown in FIGS. 1, 2A, and 2B, the side 302 of the cover 300 nearest the straw hole 106 includes the protrusion 304, which is shaped similarly to the straw hole 106, and the side 302' of the cover 300 nearest the spout 108 includes the protrusion 306, which is shaped similarly to the spout 108. Of course, the protrusions 304, 306 and the apertures 106, 108 may take on a variety of shapes, such as contoured, elliptical, polygonal, and the like, other than the straw holes and spouts shown.

Figure 3:
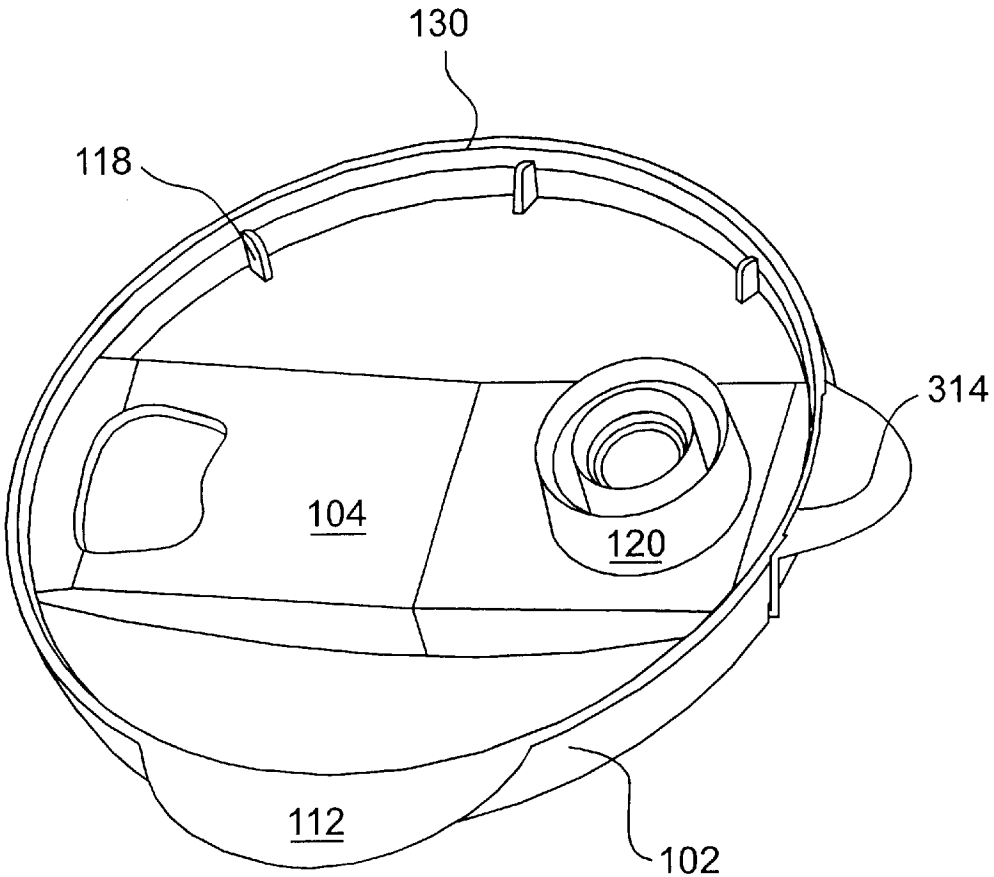
FIG. 3 is a perspective view of an underside of the lid shown in FIG. 1.

As illustrated in FIGS. 2A and 2B, the cover 300 comprises an L-shaped handle 308 extending orthogonally from the side 302. The handle 308 has an orthogonal panel 310 perpendicular to the side 302 and a parallel panel 312 parallel to the side 302, thus forming the "L-shaped" handle 308. Near a corner formed by an intersection of the panels 310, 312 of the handle 308, a first rib 314 is formed. When the cover 300 is closed over the straw hole 106, the first rib 314 grips a bottom edge of the wall 102, holding the cover 300 closed against the flat portion 104, as illustrated in FIG. 3. The orthogonal panel 310 also includes a second rib 316 that engages with a notch 114, shown in FIG. 5, formed in the lid 100, thus keeping the cover 300 in place over the spout 108. Although the first and second ribs 314, 316 and the notch 114 are preferably provided, they may be omitted without departing from the scope of the invention.

The cover 300 is pivotally attached to the lid 100 near the middle of the flat portion 104, as shown in FIG. 1. The flat portion 104 comprises at least one pair of protruding forks 116, preferably two pairs of protruding forks 116, and the cover 300 comprises a rod-shaped end 318 and a pair of windows 320. The rod-shaped end 318 is received by the forks 116 (e.g., the rod-shaped end 318 snaps into the forks 116) at the location of the windows 320, thereby allowing for hinged movement of the cover 300. Of course, other hinge-like structures may be used without departing from the scope of the invention, such as extending the rod-shaped end 318 beyond an endwall of the cover 300 to form extended pins and using forks or pin receiving means to restrain the cover 300 on the lid 100 via the extended pins.

An underside of the lid 100 according to the preferred embodiment is shown in FIG. 3. A cylindrical wall 120 depends from an underside of the flat portion 104 and surrounds the straw hole 106, so as to provide a structure for securing the gasket 200 in place. A ridge 130 extends around the wall 102, and a plurality of stops 118 protrude from the underside of the lid 100. Three stops 118 are shown; however, there are three additional stops on the opposite side of the flat portion 104 that are obscured by the wall 102. Nevertheless, any number of stops may be provided, from none to a continuous ridge, without departing from the scope of the invention, to provide a mating surface between the lid 100 and the container 400.

Figure 4:
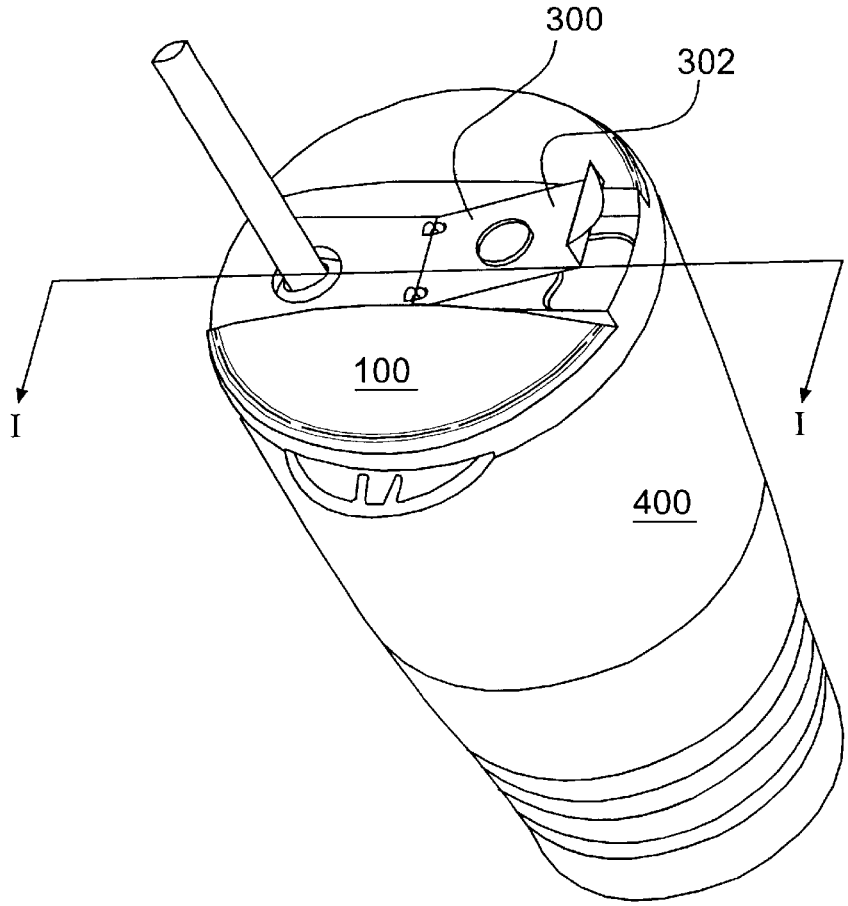
FIG. 4 is a perspective view of the lid of this invention attached to a container.
Figure 5:
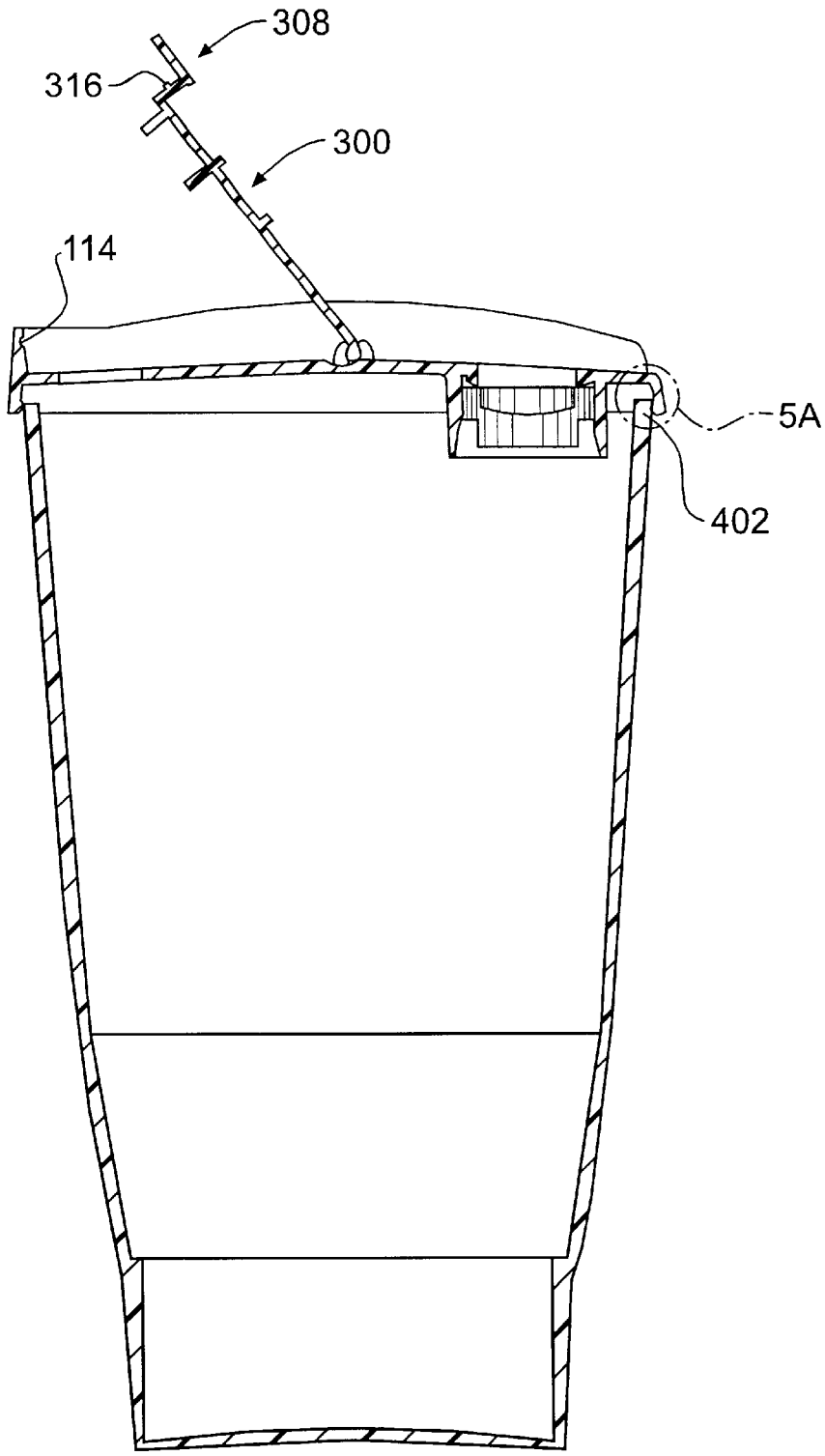
Figure 5A:
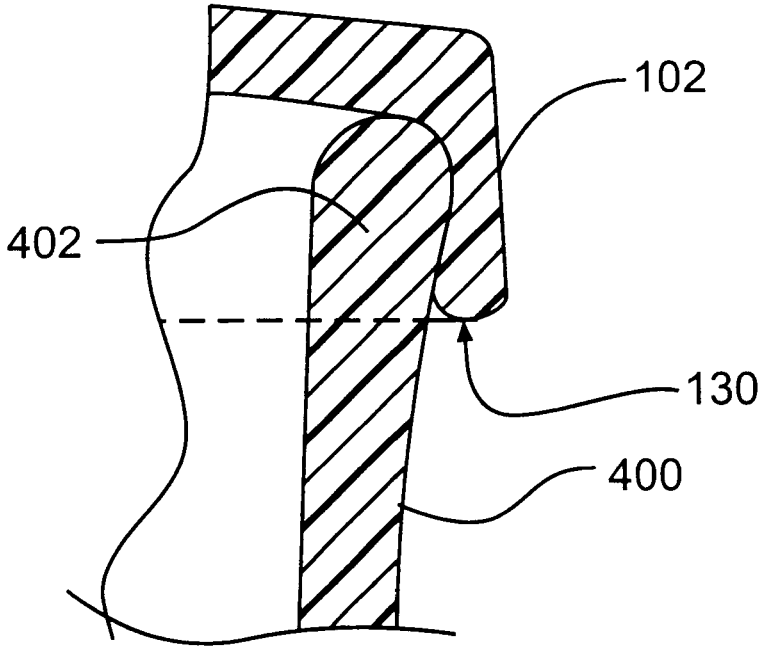
FIG. 5A is a partial cut-out sectional view of the portion 5A shown in FIG. 5.

The lid 100 is removably attachable to a container 400 having a flared top 402, as shown in FIG. 4. As illustrated in FIGS. 5 and 5A, the ridge 130 of the lid 100 contacts the flared top 402 to removably secure the lid 100 to the container 400. When the lid 100 is secured to the container 400, a seal is formed as the ridge 130 contacts the flared top 402. This seal may be a leak-resistant, a leak-proof, or a spill-proof seal. Preferably, the seal formed is a leak-proof seal. Also, when the lid 100 is secured to the container 400, the stops 118 abut the flared top 402 of the container 400. Moreover, in another aspect of the invention, the lid 100 preferably snaps onto or snap-fittingly engages with the container 400, thus producing a snapping sound upon properly attaching the lid 100 to the container 400.

The lid 100, cover 300, and container 400 can be manufactured from a variety of materials, but are preferably plastic. Such plastics include high density polyethylene (HDPE), any polyolefin, including but not limited to linear low density polyethylene (LLDPE), and low density polytheylene (LDPE). The plastics used should preferably provide a rigidity between that of LDPE and polypropylene. That is, the plastics used should preferably be rigid enough to provide a solid snapping sound when the lid 100 and the container 400 are attached together, but pliable enough to provide a leak-proof seal therebetween.

In operation, the lid 100 is attached to the container 400 containing a fluid, such as a beverage, and the cover 300 is selectively snapped down over one of the apertures, such as the spout 108, as shown in FIG. 4. A conventional straw can then be placed into the straw hole 106. Alternatively, if a user chooses to drink out of the spout 108, the user can remove the straw and pivot the cover 300 so as to cover the straw hole 106 and expose the spout 108. When done drinking, the user may pivot the cover 300 back over the spout 108. In this position, the cover 300 seals the spout 108 to prevent fluid leakage, and the gasket 200 prevents fluid leakage through the straw hole 106 in the event the container 400 is tipped over.

INDUSTRIAL APPLICABILITY

This invention provides a container lid for removable attachment to a container. This lid includes apertures, such as a straw aperture and a spout aperture, through which a user may withdraw contents of the container, and a pivotally attached cover for selectively sealing the apertures. This lid allows a user to consume the contents of the container through a straw or from a spout, while preventing external environmental objects from contacting the contents and preventing accidental spilling of the contents. When not consuming the container contents, a user may seal the spout aperture with the cover and allow a gasket within the straw aperture to seal that aperture. In this state, the lid substantially prevents the container contents from contacting the environment external thereto, thus making this invention highly suitable for use outdoors or in vehicles.

While this invention has been described with reference to what are currently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

We claim:

1. A lid comprising:

a top having a cover receiving portion, the cover receiving portion having a first aperture and a second aperture formed therein;

a hinge integral with the cover receiving portion, said hinge being positioned so that the first aperture is on one side of said hinge and the second aperture is on an opposite side of said hinge;

a cover attached to the cover receiving portion via said hinge, said cover comprising a first sidewall and a second sidewall opposite to said first sidewall, each of said first sidewall and said second sidewall having a protrusion extending therefrom and shaped so as to engage one of the first aperture and the second aperture, wherein said cover is pivotally attached to said lid via said hinge, and said cover pivots relative to the cover receiving portion so that when the protrusion on said first sidewall of said cover is pivoted toward the first aperture, the protrusion on said second sidewall of said cover simultaneously pivots away from the second aperture; and a gasket received within the first aperture to provide a spill-proof seal.

2. A lid according to claim 1, wherein the first aperture and the second aperture are different shapes.

3. A lid according to claim 1, wherein said top has a generally arcuate cross section and the cover receiving portion is substantially flat.

4. A lid according to claim 1, further comprising a wall depending from said top, said wall including a ridge for removably securing said lid to a container.

5. A lid according to claim 1, further comprising a wall depending from said top, said wall including means for snapping onto or snap-fittingly engaging with a container.

6. A lid according to claim 1, wherein said lid is generally circular.

7. A lid according to claim 1, further comprising a tongue for use in removing said cover from a container, said tongue extending from said lid.

8. A lid according to claim 1, wherein said hinge comprises a protruding fork and said cover comprises an aperture therein, said fork being adapted to pass through said aperture.

9. A lid according to claim 8, wherein the first aperture is adapted to receive a drinking device therethrough.

10. A lid according to claim 9, wherein said gasket renders the first aperture leak-resistant after the drinking device is removed from the first aperture.

11. A lid according to claim 9, wherein the drinking device is a straw.

12. A drinking assembly comprising:

a container having an upper lip; and a lid removably attached to the upper lip of said container, said lid comprising (i) a top having a substantially flat portion, the substantially flat portion having a first aperture and a second aperture formed therein; (ii) a hinge integral with the substantially flat portion, said hinge being positioned so that the first aperture is on one side of said hinge and the second aperture is on an opposite side of said hinge; (iii) a cover attached to the substantially flat portion via said hinge, said cover comprising a first sidewall and a second sidewall opposite said first sidewall, each of said first sidewall and said second sidewall having a protrusion extending therefrom and shaped so as to engage one of the first aperture and the second aperture; (iv) a wall depending from said top of said lid, wherein said wall receives the upper lip therewithin; and (v) a gasket received within the first aperture to provide a spill-proof seal.

13. A drinking assembly according to claim 12, wherein said cover is pivotally attached to said lid via said hinge, and said cover pivots relative to the substantially flat portion so that when the protrusion on said first sidewall of said cover is pivoted toward the first aperture, the protrusion on said second sidewall of said cover simultaneously pivots away from the second aperture.

14. A drinking assembly according to claim 12, wherein said wall comprises a ridge for snappingly securing said lid to said container.

15. A drinking assembly according to claim 12, wherein when said cover is engaged with the second aperture, said drinking assembly is spill-proof.

16. A drinking assembly according to claim 12, wherein a plurality of stops protrude from an underside of said lid, said stops providing a mating surface between said lid and said container.

17. A lid comprising:

a top having a cover receiving portion, the cover receiving portion having a first aperture and a second aperture formed therein;

a gasket received within the first aperture to provide a spill-proof seal;

a cover comprising means for hinging, a first sidewall extending from said means for hinging and a second sidewall directly opposite to said first sidewall extending from said means for hinging in a same direction as said first sidewall, said first sidewall having a protrusion protruding therefrom shaped to fit within the first aperture and said second sidewall having a protrusion protruding therefrom shaped to fit within the second aperture; and means for pivotally attaching said cover to the cover receiving portion, wherein said means for hinging of said cover and said means for pivotally attaching said cover to the cover receiving portion engage each other to provide for pivotal movement of said cover relative to the cover receiving portion.

18. A lid according to claim 17, wherein (i) said means for pivotally attaching said cover comprises a plurality of forks integral with the cover receiving portion, (ii) said means for hinging comprises a rod-shaped end portion of said cover and a plurality of windows formed in said cover adjacent to said rod-shaped end portion, and (iii) said forks engage said rod-shaped end portion at said plurality of windows.

* * * * *